US005385349A

United States Patent [19]

Marshall

[11] Patent Number: 5,385,349

[45] Date of Patent: Jan. 31, 1995

[54] METHOD FOR USING LIE, SHAFT POSITION, AND LOFT INDICATOR

[76] Inventor: Perry C. Marshall, 103 Granada Ct. North, Plant City, Fla. 33566

[21] Appl. No.: 186,209

[22] Filed: Jan. 25, 1994

[51] Int. Cl.[6] ..... A63B 69/36

[52] U.S. Cl. ..... 273/187.4; 273/32 H; 273/162 B; 273/194 R; 248/231; 248/219.4

[58] Field of Search ..... 273/32 H, 186.2, 194 R, 273/162 B, 187.4

[56] References Cited

U.S. PATENT DOCUMENTS

| | | | |
|---|---|---|---|
| 4,934,706 | 6/1990 | Marshall | 273/162 B |
| 4,977,680 | 12/1990 | Marshall | 273/32 H X |
| 4,993,710 | 2/1991 | Marshall | 273/162 B X |

*Primary Examiner*—George J. Marlo

*Attorney, Agent, or Firm*—Joseph C. Mason; Ronald E. Smith

[57] ABSTRACT

Three known devices for teaching golfers how to hold their clubs are structurally modified and used together as a set. The three devices are a lie indicator, a shaft position indicator, and a loft indicator. A record member is provided to record the information provided by use of all three of the devices as a set. After the three devices have been used on all of the golfer's clubs and the information provided has been recorded on the record member, further correct holding of the clubs may be obtained without further use of all three devices. Instead, the golfer merely needs to attach the shaft position indicator to each club shaft and the loft indicator to each club face, and to hold each club in the manner recorded on the record member. Accordingly, the lie indicator need not be used repeatedly, and the golfer need not remember the information recorded on the record member.

2 Claims, 6 Drawing Sheets

METHOD FOR USING LIE, SHAFT POSITION, AND LOFT INDICATOR

BACKGROUND OF THE INVENTION

1. Field of the invention

This invention relates, generally, to methods for using multiple devices having utility in practicing the game of golf.

2. Description of the prior art

Three earlier U.S. patents of the present inventor (U.S. Pat. Nos. 4,993,710, 4,934,706, and 4,977,680), respectively disclose a lie indicator having a skewed bubble tube, a combination lie and shaft position indicator, and a combination loft indicator and lie detector.

All three of the devices have utility when used separately as described in their respective disclosures, but it has been found that such independent use does not maximize the benefits of the respective tools.

Moreover, when using the earlier patented devices, the user must remember the readings produced by two of the devices if maximum benefit is to be derived therefrom.

However, when the prior art was considered as a whole, at the time the present invention was made, it was not obvious to those of ordinary skill in this field how maximum utility could be derived from the known instruments.

SUMMARY OF THE INVENTION

The present invention discloses a method for using the earlier three devices as a whole, deletes some of the functions thereof that have been found to be of minimal importance, adds a few new structural features to them, and provides a unique recording means that frees the user of the devices from having to memorize the information produced by them.

The lie indicator is improved by the addition of a ridge means that facilitates its placement on the face of a club, the combination lie and shaft position indicator is improved by deleting the lie indicator part thereof and by improving the means for mounting it to the shaft of the club, and the combination loft indicator and lie detector has been improved by deleting the lie detector part thereof and by forming the loft indicator with less materials.

Finally, a novel card is provided with preprinted information thereon, and said card includes space for the user of the three improved devices to record important information produced by the devices thereon, thereby eliminating the need to remember such information or to repeatedly use all three of the devices. The card is designed so that it is attachable to a golf club bag and thus is handy for use at all times.

An important object of this invention is to combine previously disparate teachings into a cohesive whole.

Another major object is to improve the structure of the earlier devices so that they provide maximum benefit to the golfer when used together.

Still another object is to relieve golfers from the need to remember information produced by the improved devices of this invention.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
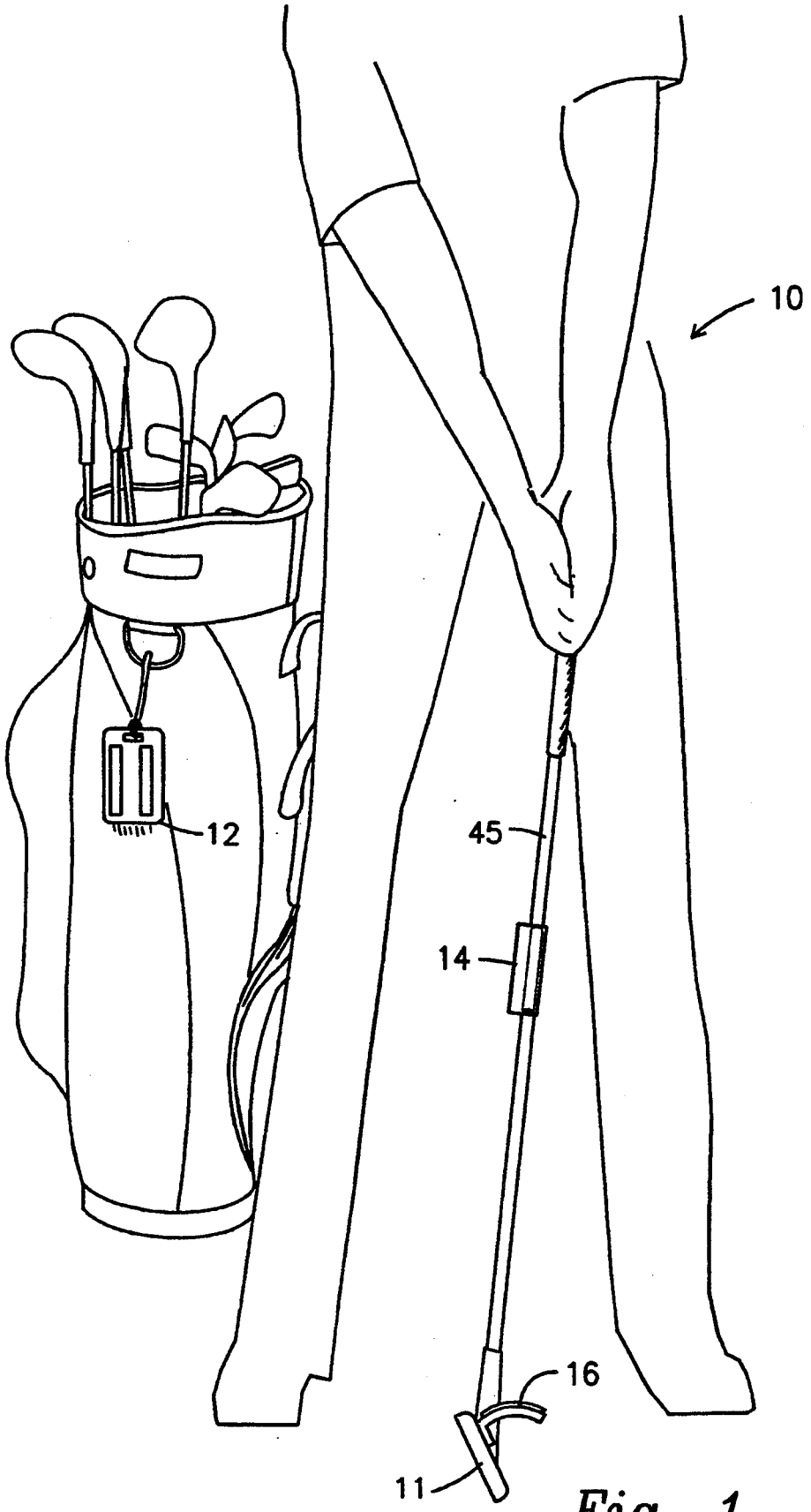
FIG. 1 is a front perspective view of a golfer holding a club equipped with the two of the three devices, and showing the novel card attached to the golf club bag.
Figure 2:
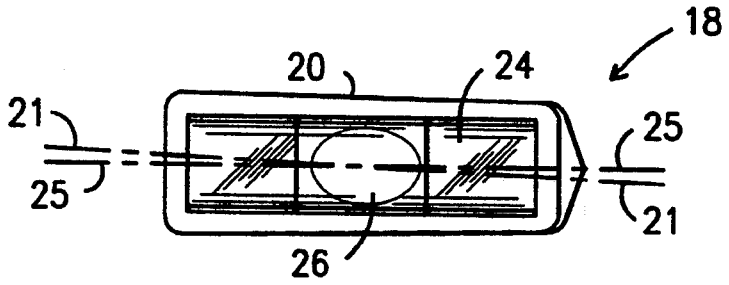
FIG. 2 is a top plan view of the skewed bubble tube.
Figure 3:
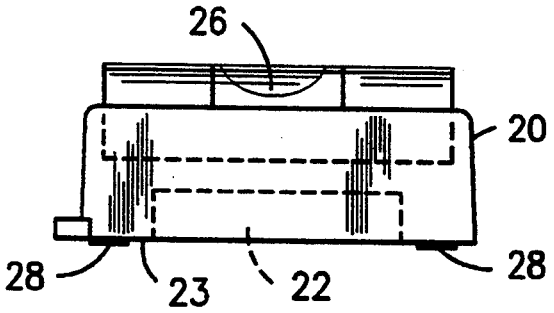
FIG. 3 is a side elevational view thereof.
Figure 4:
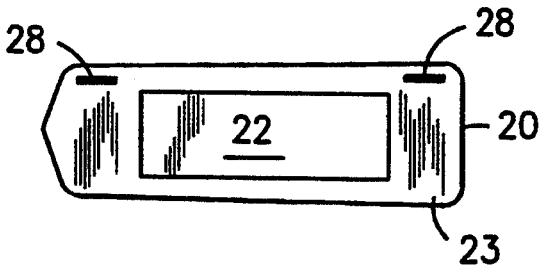
FIG. 4 is a bottom plan view thereof.
Figure 5:
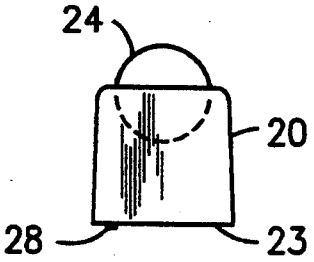
FIG. 5 is a first end view thereof.
Figure 6:
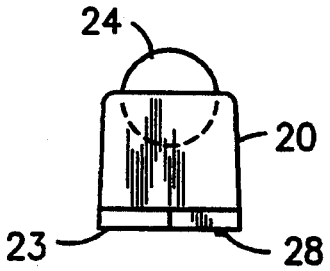
FIG. 6 is a second end view thereof.
Figure 7:
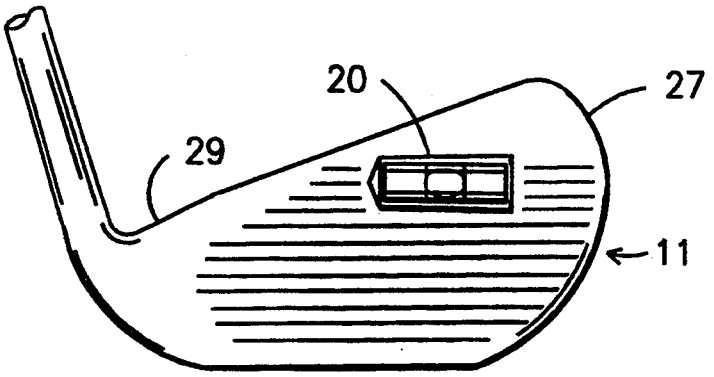
FIG. 7 depicts the skewed bubble tube positioned on a golf club face.

Referring now to FIG. 1, it will there be seen that the environment within which the novel card and the improved devices are used is denoted 10 as a whole. The card is denoted 12 and is shown hanging from a golf bag. The shaft or hand position indicator is denoted 14, and the loft indicator is denoted 16. The lie indicator is denoted 18 in FIGS. 2-7.

As shown in said FIGS. 2-7, lie indicator 18 includes a base 20, a permanent magnet 22, a straight spirit level 24 having bubble 26, and a pair of laterally spaced ridge members 28 formed on bottom wall 23 of base 20. Ridge members 28 are received in a preselected groove on a golfclub face to position lie indicator 18 in its functional position as should be clear from FIG. 7. As more fully explained in U.S. Pat. No. 4,993,710, the disclosure of which is hereby fully incorporated hereinto by reference as if fully set forth herein, the longitudinal axis of symmetry 21 of base 20 (see FIG. 2) and the longitudinal axis of symmetry 25 of spirit level 24 are skewed one degree with respect to one another so that when the golfer holds the clubhead in a level plane as indicated by the spirit level, the clubhead is actually tilted one degree from the horizontal so that the toe thereof is elevated with respect to the heel thereof. This compensates for the change in position of the clubhead that occurs when the club is swung, i.e., the mass of the clubhead deflects the toe downward one degree at the moment of ball impact. Note in FIG. 7 that although bubble 26 is centered, the toe 27 of the clubhead is elevated one degree with respect to heel 29.

FIGS. 8–13 depict the improved lie and shaft position indicator; it is denoted 30 as a whole. The lie indicator part thereof, i.e. the bubble tube denoted 22 in U.S. Pat. No. 4,934,706, the disclosure of which is hereby fully incorporated hereinto by reference as if fully set forth herein, has been deleted. When lie indicator 18 is used in accordance with the teachings of this invention, there is no need for said bubble tube 22. Accordingly, the second improved device of this invention is most accurately described as an improved shaft (or hand) position indicator.

Shaft position indicator 30 includes arcuate bubble tube 32 having bubble 34 therein and arcuate base 36. Indicia 38 are imprinted along the extent of the top surface of base 36 adjacent tube 32 so that the user may observe the position of the bubble in relation to the indicia. In accordance with the teachings of U.S. Pat. No. 4,934,706, it was incumbent upon the user to remember which indicia was adjacent to the bubble when the shaft was properly held, so that proper holding of the shaft in future practice sessions would merely require the golfer to recall which bubble position indicated the correct shaft position for that particular club, as more fully explained in the incorporated disclosure. With a large number of clubs, however, it becomes difficult for the golfer to recall which position was the proper position for each club.

Significantly, now-deleted bubble tube 22 was earlier required because bubble 34 in arcuate bubble tube 32 would provide a false reading if the shaft were not held in a vertical plane, it being understood that the function of bubble tube 22 was to enable the holding of the shaft in a vertical plane. As will become clear as this disclosure continues, the novel method and the novel recording means hereinafter disclosed obviates the need for said bubble tube 22, yet ensures that the reading provided by the improved shaft position indicator is true.

Figure 8:
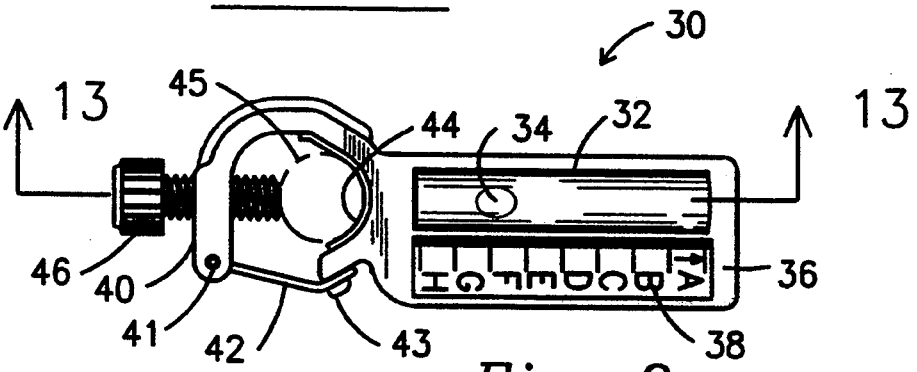
FIG. 8 is a top plan view of the shaft position indicator.
Figure 9:
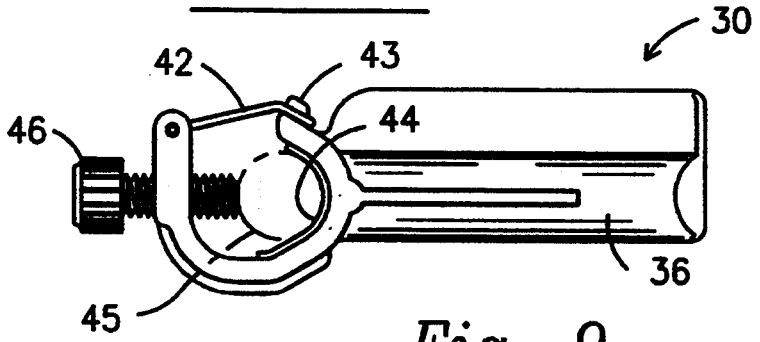
FIG. 9 is a bottom plan view thereof.
Figure 10:
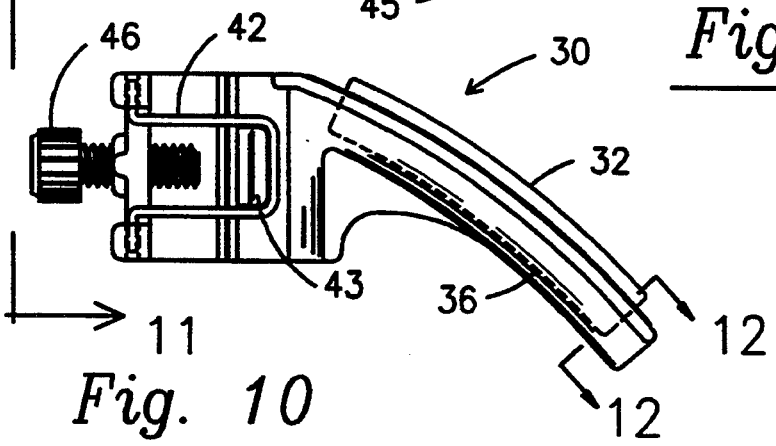
FIG. 10 is a side elevational view thereof.
Figure 11:
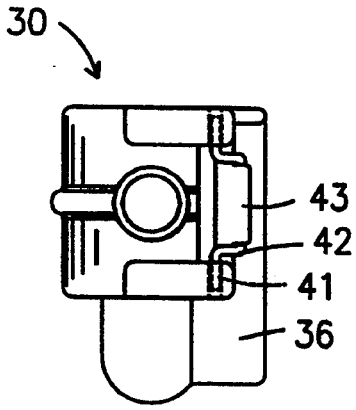
FIG. 11 is an end view taken along line 11—11 in FIG. 10.
Figure 13:
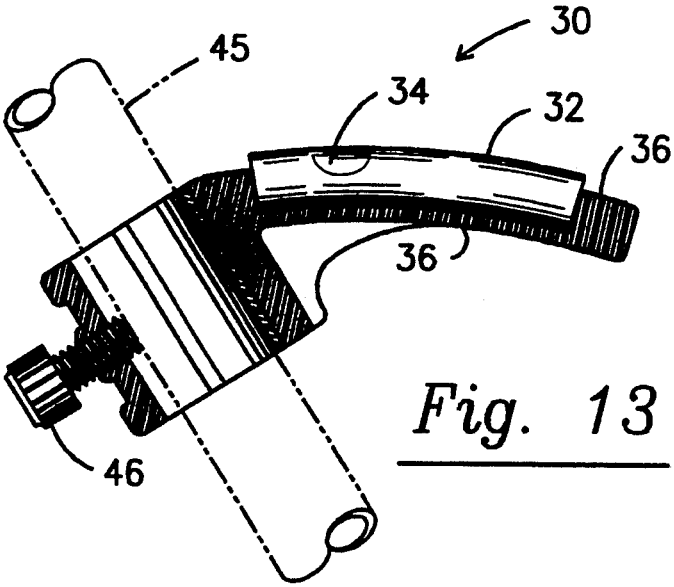
FIG. 13 is a sectional view taken along line 13—13 in FIG. 8.
Figure 12:
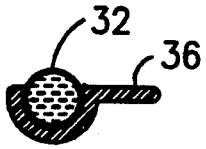
FIG. 12 is a sectional view taken along line 12—12 in FIG. 10.
Figure 15:
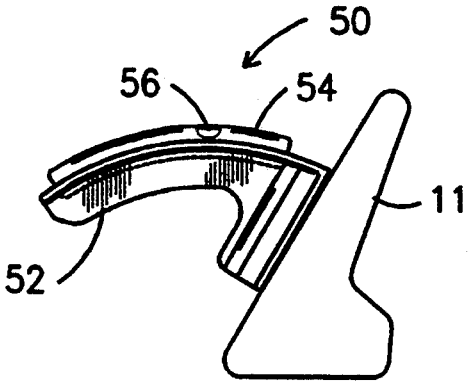
FIG. 15 is a side elevational view of the loft indicator when positioned on a club face.
Figure 14:
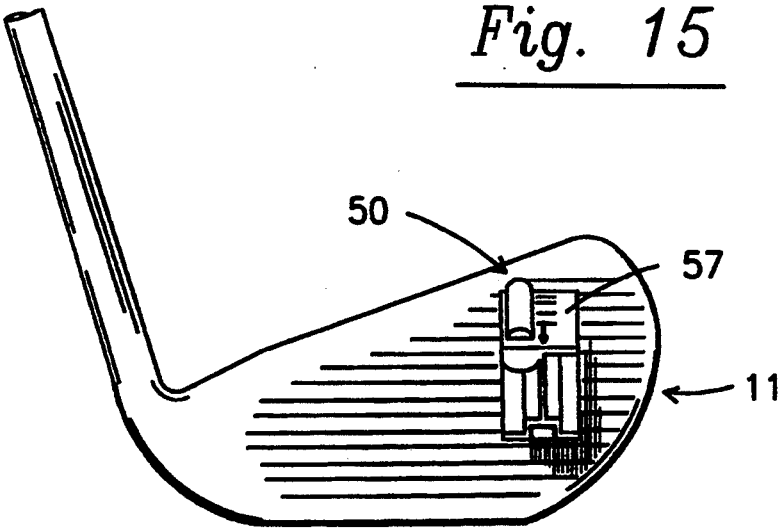
FIG. 14 depicts the loft indicator positioned on a golf club face.
Figure 16:
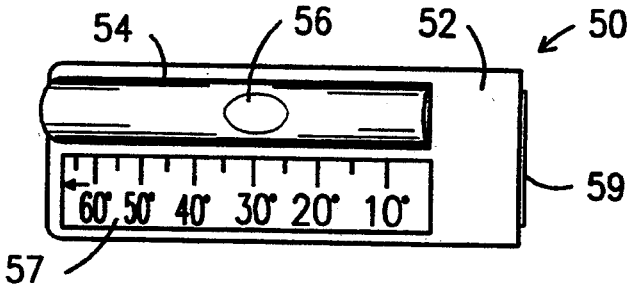
FIG. 16 is a top plan view thereof.
Figure 17:
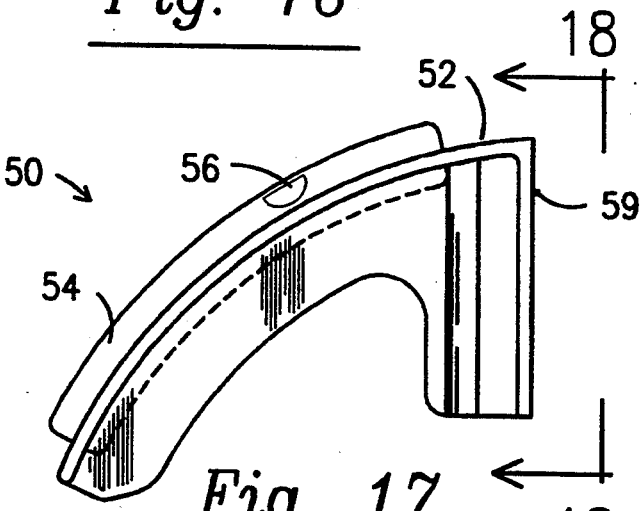
FIG. 17 is a side elevational view thereof.
Figure 18:
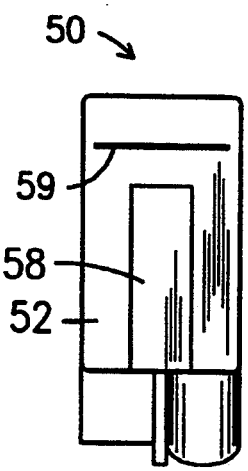
FIG. 18 is an end view taken along line 18—18 in FIG. 17.

For structural reasons, the earlier shaft position indicator device was subject to displacement when left on the club shaft during a practice swing. To prevent such displacement, the new design includes an improved means for gripping club shaft 45. Shaft gripper 40 is formed of general purpose acrylonitrile butadiene styrene (ABS) and as shown in FIGS. 8 and 9 is generally "C"-shaped; it receives and partially encircles club shaft 45. A pivotally mounted clamp 42 is pivotally mounted thereto as at 41, extends across the open end of the gripper 40, and is releasably fastened to protuberance 43 to substantially secure gripper 40 to the golf club shaft. A friction-increasing, cushioned pad member 44 prevents relative rotation between the gripper 40 and shaft 45. Set screw 46 bears against shaft 45 and completes the mounting of the hand position indicator 30 to shaft 45.

An important teaching of this disclosure is that proper use of lie indicator 18 ensures a true reading by shaft position indicator 30 and that, therefore, bubble tube 22 in incorporated U.S. Pat. No. 4,934,706 is no longer required. When the bubble in lie detector 18 is centered, the club is necessarily being held correctly. Accordingly, the position of the bubble in shaft position indicator 30 indicates the correct position of that club for the lie angle of that club head. As more fully set forth in the incorporated disclosure, the lie angle of a club head is defined as the angle between the center line of the hosel bore and the groundline at a point tangent to the center line of the club head base. Thus, the shaft position indicator 30 provides an inaccurate reading of the lie angle if lie indicator 18 is not used in conjunction therewith. When the two devices 18 and 30 are used together as disclosed herein, the reading produced by shaft position indicator 30 is accurate.

The prior art also taught the golfer to remember the readings provided by the loft indicator disclosed in U.S. Pat. No. 4,977,680, the disclosure of which is hereby fully incorporated hereinto by reference as if fully set forth herein. The improved loft indicator is denoted 50 as a whole in FIGS. 14–20; it employs less materials than its predecessor as is apparent from a comparison of the FIGS. of this disclosure and the incorporated disclosure.

Figure 19:
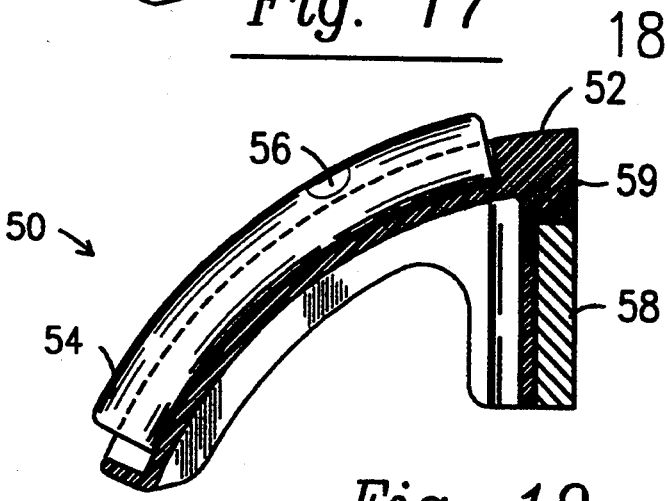
FIG. 19 is a sectional view taken along line 19—19 in FIG. 20.

Loft indicator 50 includes base 52, arcuate bubble tube 54 having bubble 56, magnet 58 positioned in a recess formed in base 52 so that the exposed surface of the magnet is flush with the surface of the base as best understood in connection with FIG. 19, and a ridge member 59 for engaging the slots formed on the club face. Indicia 57 (FIG. 16) are imprinted along the extent of tube 54, adjacent thereto.

Figure 20:
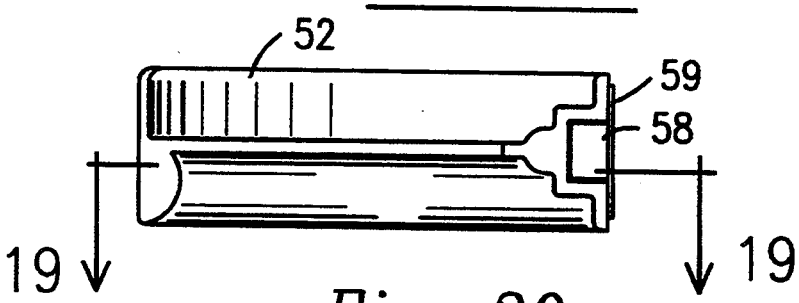
FIG. 20 is a bottom plan view of the loft indicator.

FIGS. 19 and 20 depict loft indicator 50 in use on a club head 11.

The earlier disclosure taught the user of the loft indicator to remember the loft of each club as measured by the novel device or to repeatedly measure the loft if the measurement could not be remembered.

This disclosure provides a recording device that eliminates the need for the golfer to remember the information provided by the shaft position indicator 30 and the loft indicator 50. Thus, since proper use of lie indicator 18 ensures proper shaft positioning, the novel recording device frees the golfer from repeated use of said lie indicator 18. Card 60, depicted in FIGS. 21 and 22, has two columns of indicia imprinted on a first side thereof, said indicia being denoted 62 and 64. Indicia 62 indicate the numbers of irons, i.e., the 2-iron, the 3-iron, and so forth; "PW" indicates the pitching wedge. In the empty box 66 adjacent said indicia 62, the golfer records the actual loft angle of each of said clubs as indicated; as more fully set forth in the relevant incorporated disclosure, the manufacturer's stated loft angle may not be the actual loft angle; variations of several degrees in both directions are common, i.e., a loft angle stated as being thirty degrees might be as low as twenty eight or as high as thirty two.

Significantly, the loft angle is recorded when the club head face is held square in relation to the target as depicted in FIG. 1; if the face of the club is not square to the target, the loft angle reading will be inaccurate. Inexperienced golfers may require a third party to observe the club face to ensure its squareness to the hole. Thus, when the golfer next attempts to hold the club face square to the target, if the bubble in the loft indicator is adjacent the loft angle recorded in box 66, the golfer knows that the club face is being held squarely with respect to the target.

Figure 21:
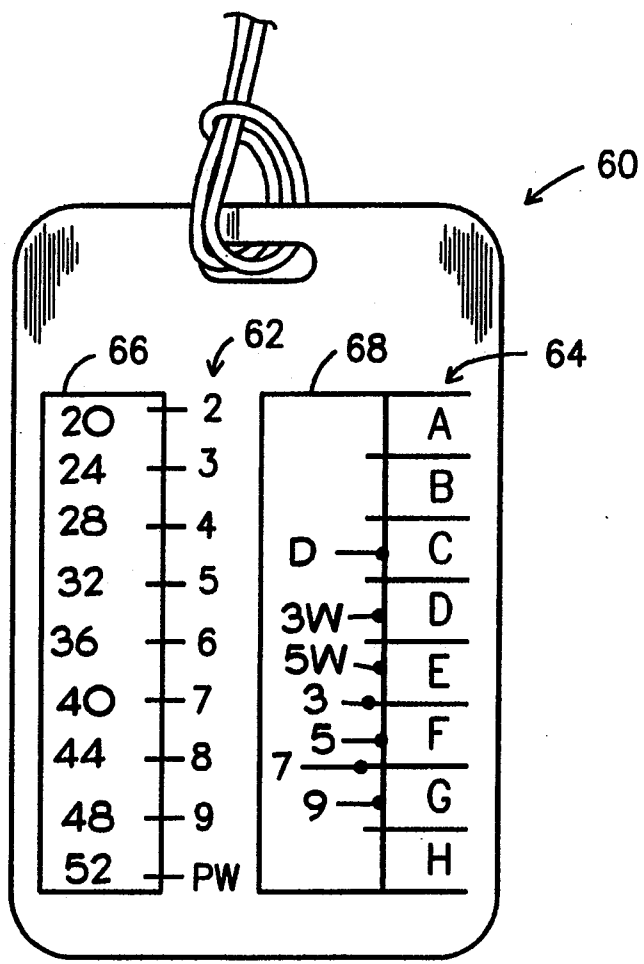
FIG. 21 is a view of a first side of the novel card.

Similarly, the readings produced by the shaft or hand position indicator 30 are recorded in the golfer's handwriting in empty box 68. Typically, only three or four recordings will be made in box 68, because most golfers practice with only three of four clubs. Seven recordings are shown in the example of FIG. 21 just to indicate that the golfer could record more readings if desired. Once the information has been recorded in box 68, the golfer need not remember the ideal bubble setting for each club. In the example shown, if the golfer decides to practice with the five iron, he or she holds the shaft as required to position the bubble in the arcuate bubble tube at the recorded position, i.e., adjacent the indicia "F." Since all positions recorded in box 68 were obtained by using level indicator 18, there is no need to use said indicator 18 again. Just as importantly, once the golfer positions the shaft of the club so that the bubble is positioned as recorded in box 68, the golfer knows that the club is being held properly, i.e., with the toe of the clubhead 11 skewed one degree upwardly from the heel thereof. Next, the golfer consults box 66 and positions the bubble in the loft indicator to the indicated position to ensure that the club head is being held squarely. In this example, the golfer will hold the club so that thirty two degrees is indicated by the loft indicator, said angle being the actual loft angle of that golfer's five iron. When the shaft position bubble is in accord with the recorded position for that club and the loft position bubble is also in accord with its recorded position, the golfer knows that the club is being held in its ideal position and a practice swing may then be taken; substantial benefit will be derived therefrom. In this manner, the loft indicator 50 serves not so much as a means for determining actual loft angle of the club as it does as a means for indicating whether or not the club head is being held squarely in relation to a target.

Note that loft indicator 50 is not used with woods; thus, when a wood is in use, only box 68 requires consultation.

Figure 22:
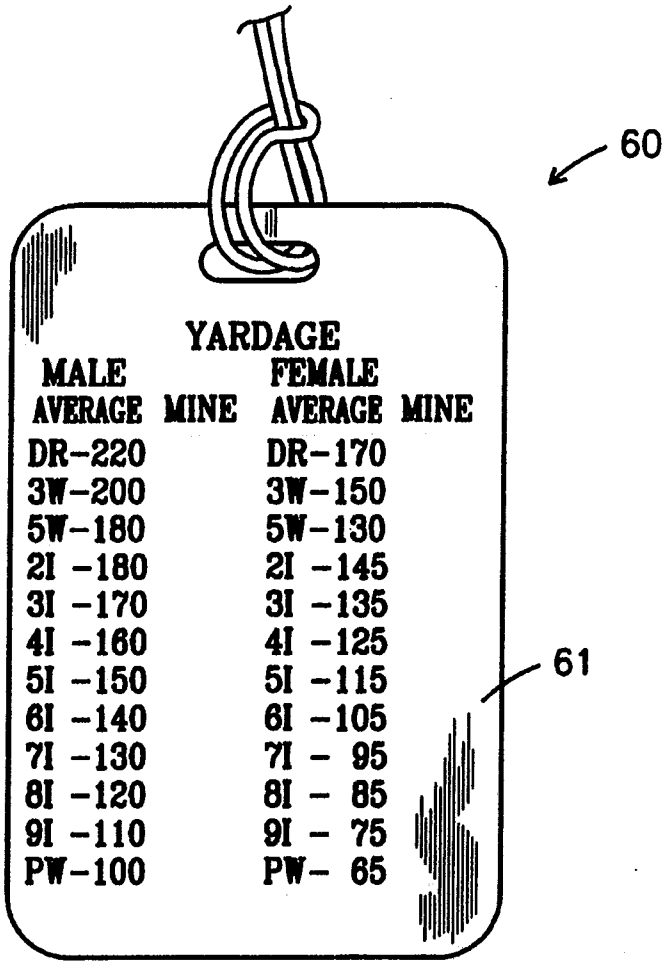
FIG. 22 is a view of a second side of said novel card.

As disclosed in FIG. 22, the reverse side 61 of novel card 60 also has utility. It records the average yardage for males and females with the various clubs and thus also serves to reduce the memory requirements of the game. Note in FIG. 1 how the card 60 is advantageously attached to a golf club bag so that it can be easily consulted.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method for using a lie detector and a shaft position indicator comprising the steps of:

releasably attaching to a golf clubhead face a lie detector having a bubble tube and a bubble therein;

releasably attaching to a golf club shaft a shaft position indicator having an arcuate bubble tube with a bubble disposed therein, and a plurality of indicia members imprinted onto an arcuate surface adjacent said arcuate bubble tube;

positioning the golf clubhead such that the bubble in the lie detector indicates a correct positioning of said clubhead;

providing a record member having preprinted indicia thereon corresponding to indicia on said shaft position indicator;

recording a reading provided by said shaft position indicator on said record member when a golf club shaft is held in its correct position as indicated by said shaft position indicator, said reading being the position of the bubble in the arcuate bubble tube in relationship to an indicia means on said arcuate surface; and holding the golf club shaft in a position where the position of the bubble in the arcuate bubble tube matches the position of the bubble as recorded in said record member for the particular club in use;

whereby future use of a preselected golf club does not require further use of the lie indicator and experimentation with various shaft positions because the user observes the recorded correct position of the club as indicated by the recorded relative positioning of said bubble and said arcuate surface and holds the club so that the bubble in the arcuate bubble tube matches the recorded position.

2. The method of claim 1, further comprising the steps of:

positioning a loft indicator on the face of a golf club head;

positioning the club head face so that it is square with a target;

recording on said record member the loft indicated by a bubble on said loft indicator when the club head face is held squarely with respect to said target;

recording on said record member the relative position of said bubble to indicia means on said loft indicator;

thereafter holding a club such that the bubble in the loft indicator is adjacent the recorded position of said bubble to assure that the club head is being held squarely with respect to a target.

* * * * *